US006109695A

United States Patent [19]

Kahwaji

[11] Patent Number: 6,109,695

[45] Date of Patent: Aug. 29, 2000

[54] CHAIR HAVING DETACHABLY INTERFITTING PARTS

[76] Inventor: Michael A. Kahwaji, 3401 Madera Ave., Los Angeles, Calif. 90039

[21] Appl. No.: 09/418,863

[22] Filed: Oct. 15, 1999

[51] Int. Cl.[7] ..... A47C 7/00

[52] U.S. Cl. ..... 297/440.13; 297/440.23; 297/354.12; 297/313

[58] Field of Search ..... 297/440.13, 440.1, 297/337, 313, 354.12, 374, 440.23, 440.15, 440.21, 217.1

[56] References Cited

U.S. PATENT DOCUMENTS

| | | | |
|---|---|---|---|
| 3,460,866 | 8/1969 | Kessel . | |
| 4,593,950 | 6/1986 | Infanti . | |
| 5,259,578 | 11/1993 | Jones et al. | 248/174 |
| 5,275,467 | 1/1994 | Kawecki | 297/440.13 |
| 5,387,027 | 2/1995 | Maloney | 297/440.13 |
| 5,605,378 | 2/1997 | Oyediran | 297/440.13 |
| 5,765,922 | 6/1998 | Hsia | 297/440.1 |
| 5,803,548 | 9/1998 | Battle | 297/440.13 |
| 5,992,938 | 11/1999 | Jones . | |

*Primary Examiner*—Milton Nelson, Jr.

[57] ABSTRACT

A chair assembly having detachably interfitting parts. A right hand side support of the chair assembly includes slots extending from the exterior profile of the first side support towards the center of the side support. A left hand side support similar to the right hand side support is also provided. A seat pan having extensions is fitted into two complementary slots of the right and left side supports. A back support having extensions is also fitted into two complementary slots of the right and left side supports. The seat pan and the back support may be independently adjusted so as to present various sitting positions.

17 Claims, 3 Drawing Sheets

CHAIR HAVING DETACHABLY INTERFITTING PARTS

BACKGROUND OF THE INVENTION

1. Field of the Invention

The present invention relates generally to chairs, and more particularly to chairs having detachably interfitting slotted parts or components that may be normal to each other.

2. Background Information

A chair is generally viewed as a seat for one person with a support for the back. Knockdown chairs include those chairs having interfitting parts that easily detach so as to be able to transport or store the chair more efficiently. Examples of such chairs include U.S. Pat. No. 5,275,467 entitled "Knockdown Chair," U.S. Pat. No. 5,387,027 entitled "Take Apart Furniture," U.S. Pat. No. 5,605,378 entitled "Take-Apart Chair," U.S. Pat. No. 5,765,922 entitled "Portable Combination Chair," U.S. Pat. No. 5,803,548 entitled "Collapsible Chair Apparatus," and U.S. Pat. No. 5,921,631 entitled "Demountable chair construction"

Although no hardware is needed to assembly the above inventions, the assembly of each of the above chairs is not intuitive and thus require instructions. Moreover, the above inventions only present the user with one position by which to support their back and upper legs and lack give in the seat and/or back that is necessary for comfort. Thus, what is needed is a comfortable, knockdown chair that may be assembled intuitively into a multitude of seating positions.

BRIEF SUMMARY OF THE INVENTION

The invention relates to a chair assembly having detachably interfitting parts. A right hand side support includes slots extending from the exterior profile of the first side support towards the center of the side support. A left hand side support similar to the right hand side support is also provided. A seat pan having extensions is fitted into two complementary slots of the right and left side supports. A back support having extensions is also fitted into two complementary slots of the right and left side supports. The seat pan and the back support may be independently adjusted so as to present various sitting positions.

DETAILED DESCRIPTION OF THE INVENTION

For purposes of explanation, specific embodiments are set forth to provide a thorough understanding of the present invention. However, it will be understood by one skilled in the art from reading this disclosure that the invention may be practiced without these details. Moreover, well-known elements, devices, process steps and the like are not set forth in detail in order to avoid obscuring the invention.

Figure 1:
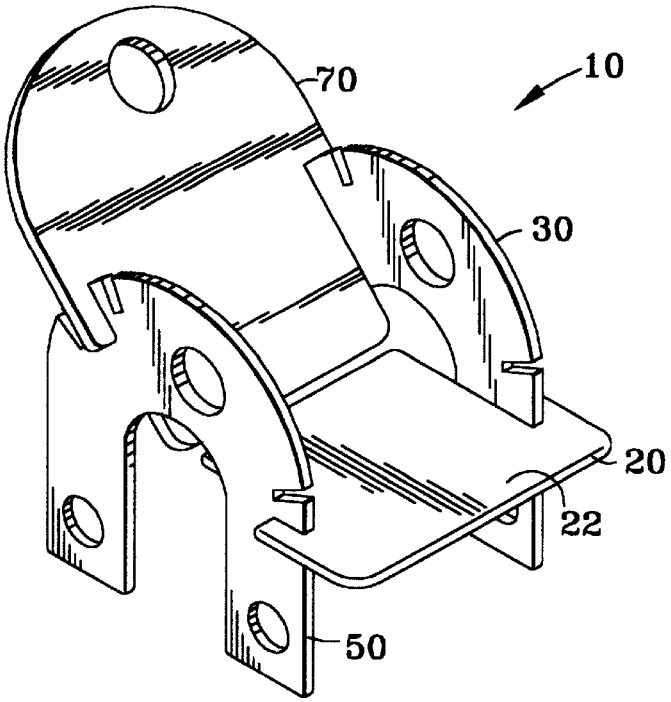
FIG. 1 is an isometric view of an embodiment of an assembled chair.
Figure 2:
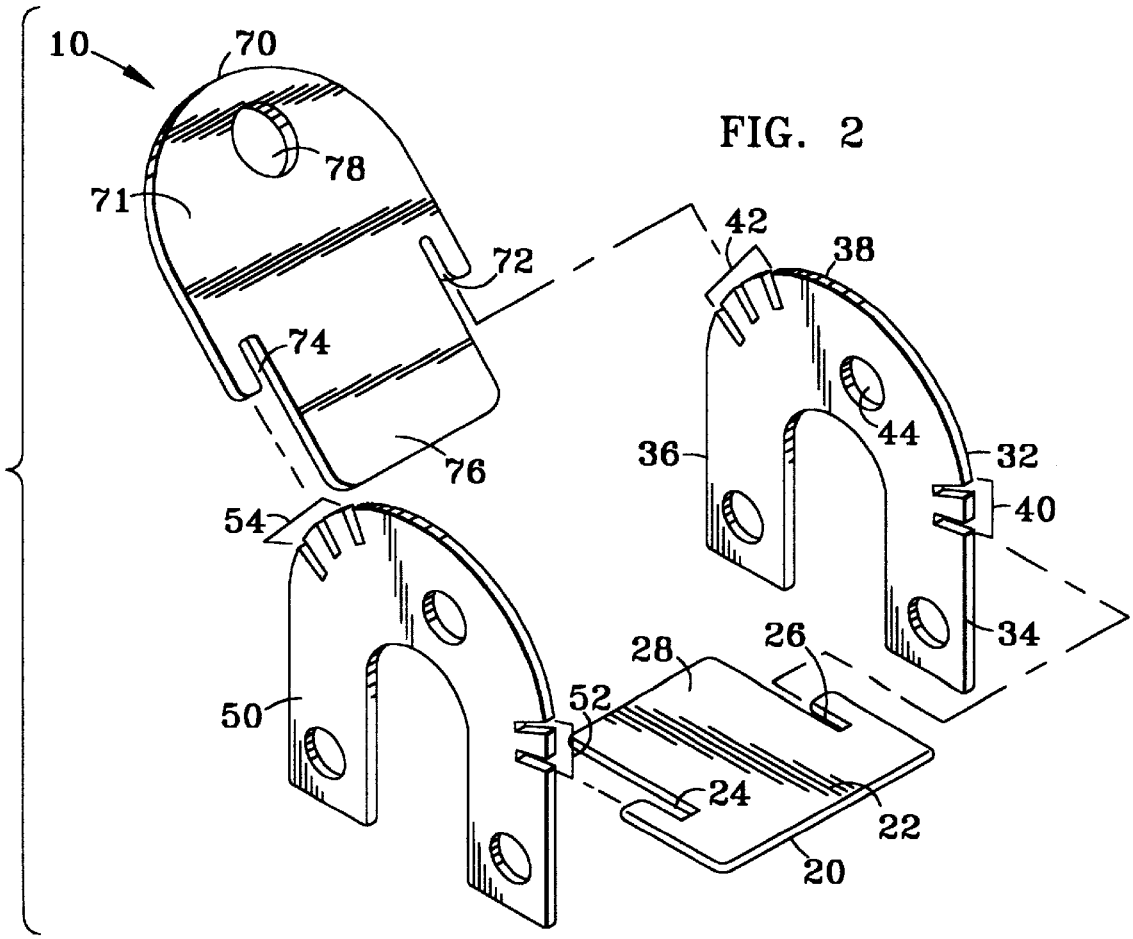
FIG. 2 is an exploded perspective view of an embodiment of an assembled chair.

Reference is now made to FIG. 1 through FIG. 5 to illustrate the embodiments of the invention. FIG. 1 is an isometric view of an embodiment of assembled chair 10. FIG. 2 is an exploded perspective view of an embodiment of assembled chair 10. Included with assembled chair 10 is seat pan 20, side support 30, side support 50, and back support 70.

Seat pan 20 may be any support on which a person places their behind so as to remove the bulk of their weight from their feet. Surface 22 of seat pan 20 preferably is flat, as shown in FIG. 1. However, surface 22 of seat pan 20 may be contoured to better fit the shape of a human behind or be any shape that is consistent with providing support for a human behind. The front of seat pan 20 may be straight or contoured.

In one embodiment of the invention, seat pan 20 includes slot 24, slot 26, and rear portion 28. Each of slot 24 and slot 26 may be formed in an extension and be viewed as a narrow depression, perforation, or aperture especially used for the reception of a piece fitting within the slot. Rear portion 28 may be thin enough so as to provide some flexible give. Alternatively or additionally, rear portion 28 may be slotted so as to provide some flexible give.

Side support 30 and side support 50 preferably are of identical pattern so as to minimize the design parts necessary to form chair assembly 10. Side support 30 may be of a half oval construction so as to include annular ring 32 having front leg 34 and back leg 36 extending from annular ring 32 as best seen in FIG. 2. Side support 30 may be of a solid half oval construction so that front leg 34 and back leg 36 are connected by a continuous piece of material. Back leg 36 and front leg 34 of side support 30 may extend to the surface of a plane or may include a curvature piece such as seen in a rocking chair.

Annular ring 32 preferably includes external circular profile 38. Along the exterior profile of side support 30 may be a series of slots extending from the exterior profile of side support 30 towards the center line of the half oval construction of side support 30. These slots provide the support and adjustment features for seat pan 20 and back support 70.

Preferably the series of slots are separate and divided into slot group 40 and slot group 42. Slot group 40 and slot group 42 may include one or more slots extending radially inward to the center of circular profile 38 from the exterior of circular profile 38. The slots may have stress reliefs at the ends such as in the form of circular cutouts. Although only a few slots are shown in FIG. 2 for slot group 40 and slot group 42, many more slots may be included. Similar to side support 30, side support 50 includes slot group 52 and slot group 54 as companion slots to slot group 40 and slot group 42, respectively.

Included within side support 30 may be one or more holes 44. Hole 44 provides relief for stresses that may build up in side support 30 during use. Moreover, holes 44 lightens the overall weight of chair assembly 10 as well as provides locations by which a user may grab side support 30.

Back support 70 may be any support on which a person places their back so as to remove some of their torso weight from their pelvis. Surface 71 of back support 70 preferably is flat, as shown in FIG. 2. However, surface 71 of back support 70 may be contoured to better fit the shape of a human back or be any shape that is consistent with providing support for a human back. The top of back support 70 preferably is curved and includes hole 78.

Figure 5:
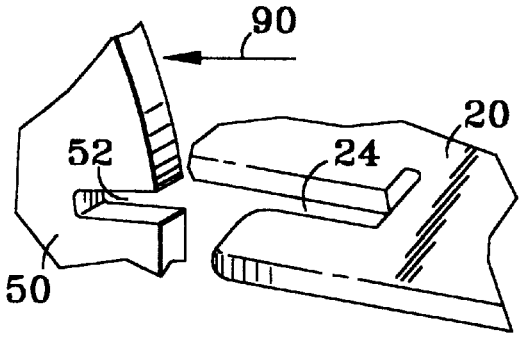
FIG. 5 is an isometric section view of an embodiment of the assembly of a chair taken generally off of line 5—5 of FIG. 2

In one embodiment of the invention, back support 70 includes slot 72, slot 74, and lower portion 76. Each of slot 72 and slot 74 may be viewed as a narrow depression, perforation, or aperture especially used for the reception of a piece fitting within the slot. Lower portion 76 may be thin enough so as to provide some flexible give. As seen in FIG. 5, seat pan 20 and back support 70 are of lengths where rear portion 28 and lower portion 76 do not interfere with one another.

To assemble chair assembly 10, slot 26 and slot 24 of seat pan 20 is fitted within a slot from slot group 40 and slot group 52, respectively. Similarly, slot 74 and slot 72 are fitted within a slot from slot group 42 and slot group 54, respectively.

Figure 3:
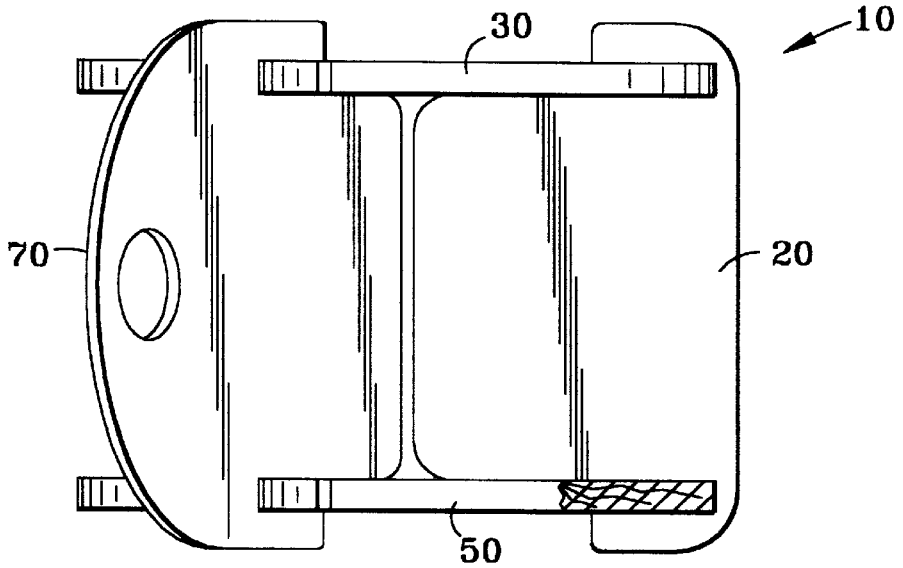
FIG. 3 is a top view of an embodiment of an assembled chair.
Figure 4:
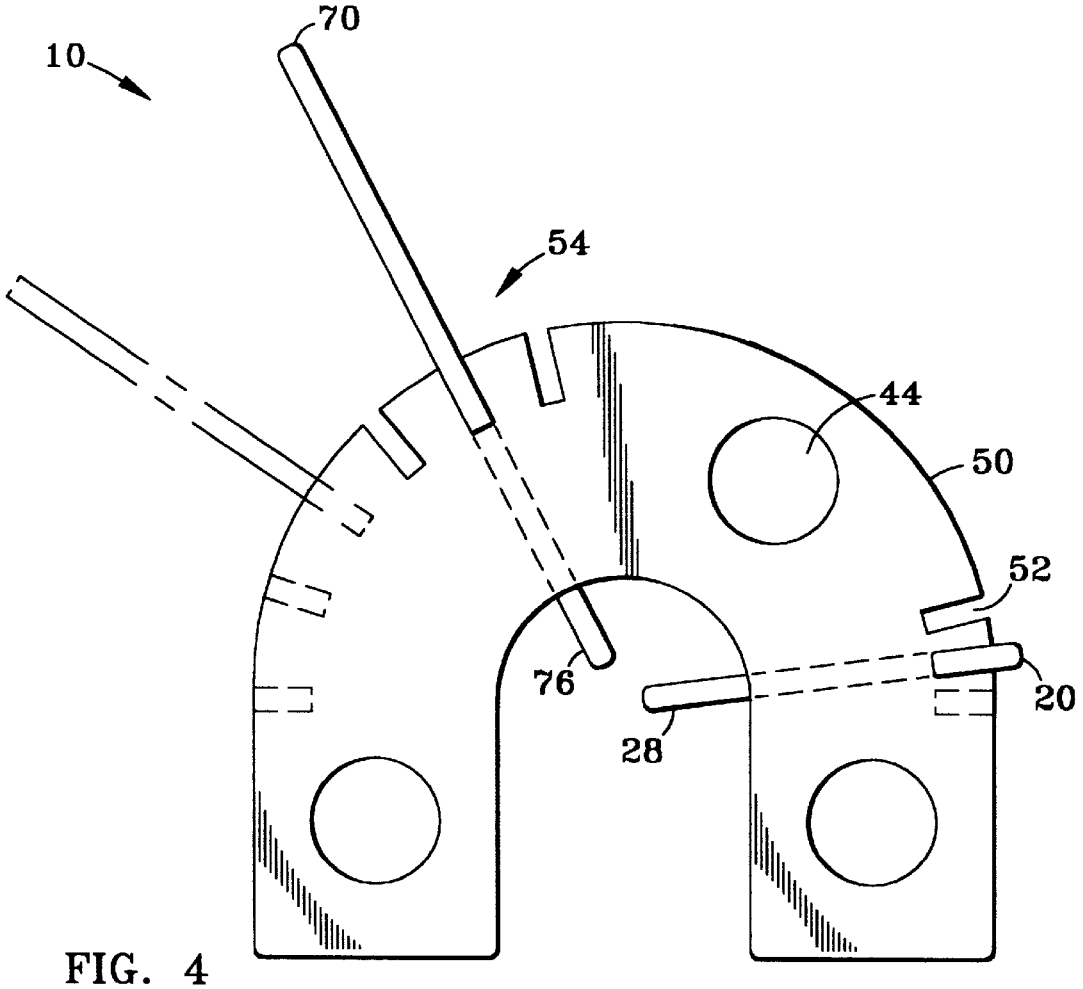
FIG. 4 is a side view of an embodiment of an assembled chair showing the different orientations of the back and the seat.

FIG. 3 is a top view of an embodiment of assembled chair 10. FIG. 4 is a side view of an embodiment of assembled chair 10 showing the different orientations of back support 70 and seat pan 20. FIG. 5 is an isometric section view of an embodiment of the assembly of a chair taken generally off of line 5—5 of FIG. 2. As shown in FIG. 5, slot 24 of seat pan 20 may be fitted into slot 52 of side support 50 in the direction of arrow 90. By varying which slots are used within slot group 52 and slot group 54, a multitude of seating positions may be obtained for seat pan 20 and back support 70. Preferably, chair assembly 10 is adjustable to six different positions where back support 70 accommodates angles of 105, 120, and 130 degrees and seat pan 20 accommodate angles of 5.5 and 15 degrees.

Preferably, the pieces of chair assembly 10 are made of a high grade plywood, such as medium density fireboard (MDF) or eighteen ply plywood, where each ply is three fourths of an inch thick. Use of MDF minimizes the need for finishing processes.

Figure 6:
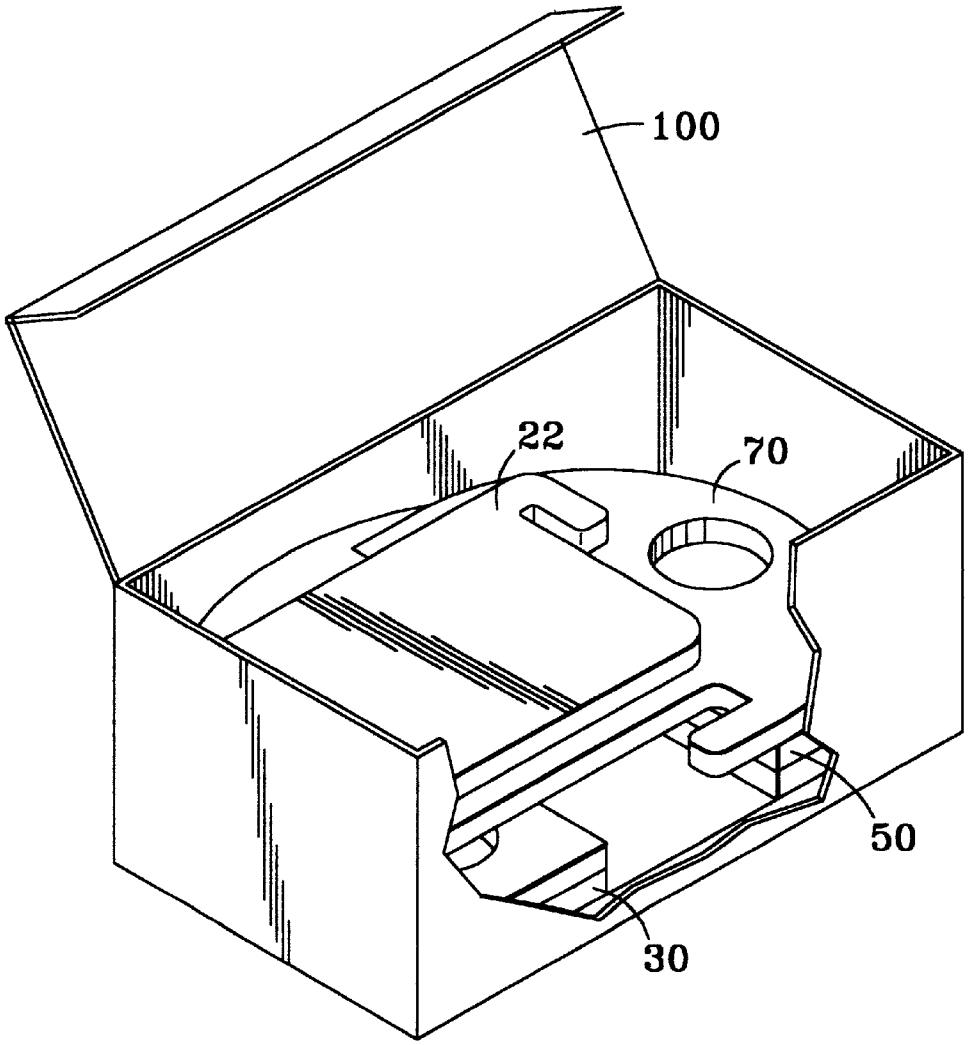
FIG. 6 illustrates a ready to assemble chair within box 100.

The ready to assembly chair can be rapidly produced by the use of templates with minimum waste so as to be environmentally friendly. The yield of the material is approximately 94%, making the chair environmentally friendly and providing low manufacturing costs. The finished product can be packaged in box 100 as shown in FIG. 6. Box 100, which may be a recycled cardboard box, may have a height that is less than one fifth of at least one of the width and the length. For example, the dimensions of box 100 may be 25×30×5 inches or 25×30×3.5 inches. The sleek (3.5 inch), almost square size (25×30 inches) of the packaging box permits several chair assemblies 20 to be stacked during shipping. With more units shipped in a given cargo space, the cost of shipping as well as the pollution created by additional deliveries is reduced.

While the present invention has been particularly described with reference to the various figures, it should be understood that the figures and detailed description, and the identification of certain preferred and alternate materials, are for illustration only and should not be taken as limiting the scope of the invention or excluding still other alternatives. Many changes and modifications may be made to the invention, by one having ordinary skill in the art, without departing from the matter and scope of the invention.

What is claimed is:

1. A chair assembly having detachably interfitting parts, the chair assembly comprising:

a first side support having an exterior profile and a vertical center line, the first side support further having a plurality of slots extending from the exterior profile of the first side support towards the vertical center line, wherein the plurality of slots of the first side support includes at least three slots;

a second side support having a plurality of slots, wherein at least one slot of the second side support is in vertical alignment with at least one slot of the plurality of slots of the first side support;

a seat pan having a first extension disposed in one of the plurality of slots of the first side support and a second extension disposed in one of the plurality of slots of the second side support; and a back support having a first extension disposed in one of the plurality of slots of the first side support and a second extension disposed in one of the plurality of slots of the second side support.

2. The chair assembly of claim 1, wherein the plurality of slots of the first side support are divided into a group of seat pan slots and a group of back support slots that is separately distinct from the group of seat pan slots.

3. The chair assembly of claim 2, wherein the exterior profile of the first side support is defined by a radius of constant length from a center point and wherein each slot extends radially towards the center point.

4. The chair assembly of claim 2, wherein the group of seat pan slots includes two slots.

5. The chair assembly of claim 4, wherein the group of back support slots includes three slots.

6. The chair assembly of claim 5, wherein the two slots of the group of seat pan slots are located at angles of 5.5 and 15 degrees relative to a plane that is perpendicular to the vertical center line of the first side support and wherein the three slots of the group of back support slots are located at angles of 105, 120, and 130 degrees relative to the plane.

7. The chair assembly of claim 6, at least one side support having material removed to define at least one hole.

8. The chair assembly of claim 1, wherein the first extension of the seat pan includes a slot interfitted with a slot of the plurality of slots of the first side support and wherein the second extension of the seat pan includes a slot interfitted with a slot of the plurality of slots of the second side support.

9. The chair assembly of claim 8, wherein the first extension of the back support includes a slot interfitted with a slot of the plurality of slots of the first side support and wherein the second extension of the back support includes a slot interfitted with a slot of the plurality of slots of the second side support.

10. The chair assembly of claim 9, wherein the exterior profile of the first side support is defined by a half oval construction.

11. The chair assembly of claim 10, wherein the seat pan includes a flexible rear portion.

12. The chair assembly of claim 11, wherein the back support includes a flexible lower portion.

13. The chair assembly of claim 12, wherein the plurality of slots are evenly distributed over the exterior profile of the first side support.

14. A breakdown chair, comprising:

a first side support having an exterior profile and a vertical center line, the first side support further having a plurality of slots extending from the exterior profile of the first side support towards the vertical center line;

a second side support having a plurality of slots, wherein at least one slot of the second side support is in vertical alignment with at least one slot of the plurality of slots of the first side support;

a seat pan having a first extension disposed in one of the plurality of slots of the first side support and a second extension disposed in one of the plurality of slots of the second side support;

a back support having a first extension disposed in one of the plurality of slots of the first side support and a second extension disposed in one of the plurality of slots of the second side support; and a box disposed about the first side support, the second side support, the seat pan, and the back support.

15. The breakdown chair of claim 14, wherein the plurality of slots of the first side support are divided into a group of seat pan slots and a group of back support slots that is separately distinct from the group of seat pan slots.

16. The breakdown chair of claim 15, wherein the box is a cardboard box having a height, a width, and a length, wherein the height is less than one fifth of at least one of the width and the length.

17. The breakdown chair of claim 16, wherein the dimensions of the box are 25×30×3.5 inches.

* * * * *